US007478678B2

(12) United States Patent
Farrar et al.

(10) Patent No.: US 7,478,678 B2
(45) Date of Patent: Jan. 20, 2009

(54) TIME RELEASE DOWNHOLE TRIGGER

(75) Inventors: Amy L. Farrar, Houston, TX (US); Douglas J. Murray, Humble, TX (US); Gregory C. Badke, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 120 days.

(21) Appl. No.: 11/316,020

(22) Filed: Dec. 21, 2005

(65) Prior Publication Data

US 2007/0137865 A1 Jun. 21, 2007

(51) Int. Cl.
*E21B 23/08* (2006.01)
*E21B 41/00* (2006.01)

(52) U.S. Cl. ..... 166/387; 166/142; 166/188; 277/333; 277/336

(58) Field of Classification Search ..... 166/373, 166/387, 142, 188, 319; 277/333, 336
See application file for complete search history.

(56) References Cited

U.S. PATENT DOCUMENTS 2,852,081 A * 9/1958 Lebourg ..... 166/169
3,123,143 A * 3/1964 Annis et al. ..... 277/333
3,712,052 A * 1/1973 Staschke et al. ..... 60/527
4,614,156 A * 9/1986 Colle et al. ..... 102/312
5,058,673 A * 10/1991 Muller et al. ..... 166/187
6,568,470 B2 * 5/2003 Goodson et al. ..... 166/66.5
2004/0194971 A1 * 10/2004 Thomson ..... 166/387
2005/0171248 A1 8/2005 Li et al.
2006/0175065 A1 * 8/2006 Ross ..... 166/386

* cited by examiner

*Primary Examiner*—Shane Bomar
(74) *Attorney, Agent, or Firm*—Steve Rosenblatt

(57) ABSTRACT

A setting mechanism is made to respond to hydrostatic pressure. Upon reaching a predetermined depth corresponding to a given pressure, a pilot piston is shifted to allow well fluids to bypass a first set of piston seals and reach a second set. A shear pin that held the pilot piston in position is broken as the hydrostatic pressure increases with greater depth attained. However, the shifting of the pilot piston does not cause the main piston in the assembly to set the downhole tool. The action of the well fluids on the secondary seal set on the pilot piston eventually fail the second seal set allowing hydrostatic pressure to bypass them and actuate the main piston that will set the downhole tool. Raising the tool from the wellbore allows the spring acting on the pilot piston to seal in a bore to isolate hydrostatic pressure from the operating piston.

8 Claims, 2 Drawing Sheets

TIME RELEASE DOWNHOLE TRIGGER

FIELD OF THE INVENTION

The field of this invention is mechanisms that can trigger one or more downhole tools that employ a time delay from the point of actuation to allow coordination of operations downhole.

BACKGROUND OF THE INVENTION

Downhole tools are delivered on strings to proper positions in the wellbore. In the case of packers an inner string is used to set the packer when the proper depth is reached. It is at times desirable to set downhole tools in a particular sequence. Bottom up has been a way to set a series of external casing packers on a casing string.

One type of actuating mechanism that has been used in the past is to take advantage of hydrostatic pressure available in the wellbore to set a downhole tool like a sliding sleeve or a packer, for example. These hydrostatically actuated mechanisms were still triggered by an inner string that shifted a sleeve, for example, to allow the hydrostatic pressure access to an actuating piston. An example of the prior design of such a triggering mechanism that was actuated by hydrostatic pressure is illustrated in FIGS. 1 and 2. A mandrel 10 is illustrated schematically to have a valve 12 that can selectively align hydrostatic pressure in passage 14 to first atmospheric chamber 16. The prior art design generally used a sliding sleeve for valve 12 that had to be shifted manually. Seals 18 and 20 along with valve 12 initially hold the atmospheric pressure in chamber 16. Passage 14 can be inside the mandrel 10 or outside of it. As shown in FIG. 2, when valve 12 is opened with an inner string, for example, that is not shown, the hydrostatic pressure communicates from passage 14 to chamber 16 and winds up pushing piston as chamber 24, which is initially at atmospheric pressure as was chamber 16 is reduced in volume while chamber 16 increases in volume. The movement of piston 22 causes these volume changes. Atmospheric pressure in chamber 24 is initially trapped there by seals 26 and 28. Movement of piston 22 operates a downhole tool, like setting an external casing packer, for example.

The reason for the valve 12 is to allow time for proper positioning of the downhole tool, such as a packer, before the hydrostatic pressure sets it. Since the exact trigger depth cannot be a certainty, the past designs have employed valves such as 12 in conjunction with an inner string to operate said valves when the proper placement was assured. However, running another string to set one or more downhole tools such as packers was time consuming and therefore expensive. Additionally, once the sliding sleeve that functioned as valve 12 was actuated, there was no delay and the downhole tool set immediately from hydrostatic pressure. The present invention provides a solution to the cost of the running of the inner string by a creating a delay incorporated into the prior trigger designs that allow time to ensure proper placement before the tool is set and yet removes the need for running an inner string or the like to initiate the setting sequence. Multiple mechanisms can be employed with different delay times built in to trigger devices in a particular order. These and other advantages of the present invention will be more apparent to those skilled in the art from a review of the description of the preferred embodiment, the drawings and the claims below, which define the scope of he invention.

SUMMARY OF THE INVENTION

A setting mechanism is made to respond to hydrostatic pressure. Upon reaching a predetermined depth corresponding to a given pressure, a pilot piston is shifted to allow well fluids to bypass a first set of piston seals and reach a second set. A shear pin that held the pilot piston in position is broken as the hydrostatic pressure increases with greater depth attained. However, the shifting of the pilot piston does not cause the main piston in the assembly to set the downhole tool. The action of the well fluids on the secondary seal set on the pilot piston eventually fail the second seal set allowing hydrostatic pressure to bypass them and actuate the main piston that will set the downhole tool. Raising the tool from the wellbore allows the spring acting on the pilot piston to seal in a bore to isolate hydrostatic pressure from the operating piston.

DETAILED DESCRIPTION OF THE PREFERRED EMBODIMENT

Figure 1:
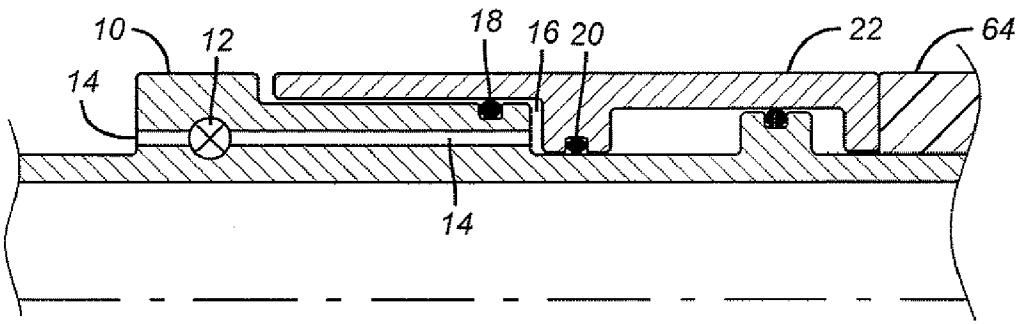
(PRIOR ART) FIG. 1
FIG. 1 is a schematic view of a prior art design in the run in position.
Figure 2:
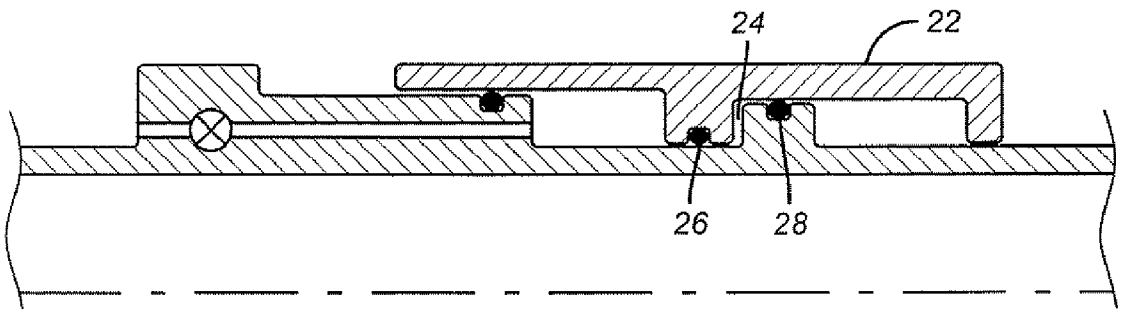
(PRIOR ART) FIG. 2
FIG. 2 is the view of FIG. 1 in the set position.

In the present invention the valve 12 of the prior art FIGS. 1 and 2 is replaced by the assembly that is shown. Passage 14 is still there but this time it has a retainer 30 held at thread 32 to mandrel 10. Valve body 34 is a generally cylindrically shaped elongated member with one ore more primary seals 36. Seals 36 are compatible with downhole fluids and are initially disposed opposite bore 38. One or more secondary seals 40 are initially disposed in bore 42. In between seals 36 and 40 there is a reduced diameter section 44 that is initially disposed opposite enlarged bore 46 that is disposed between bores 38 and 42. A retainer ring 48 is supported on shoulder 50 of mandrel 10 and has a shear pin or equivalent object 52 that extends into extension 54 of body 34. A spring 56 surrounds extension 54 to push body 34 against retainer 32 during run in. Spring 56 bears on ring 48 and on shoulder 58 of body 34. Passage 14 continues beyond ring 48 into chamber 16 as illustrated in FIG. 1.

Figure 4:
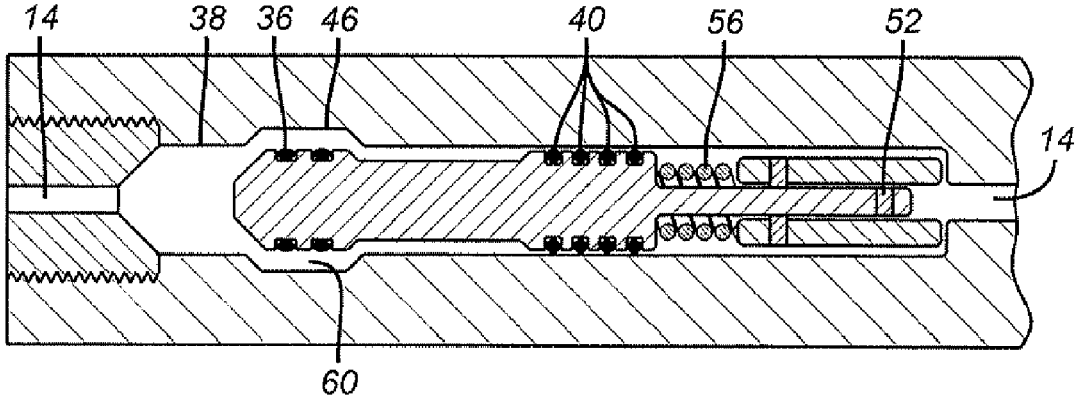
FIG. 4 is the view of FIG. 3 in the stroked position with the backup seals still intact.
Figure 5:
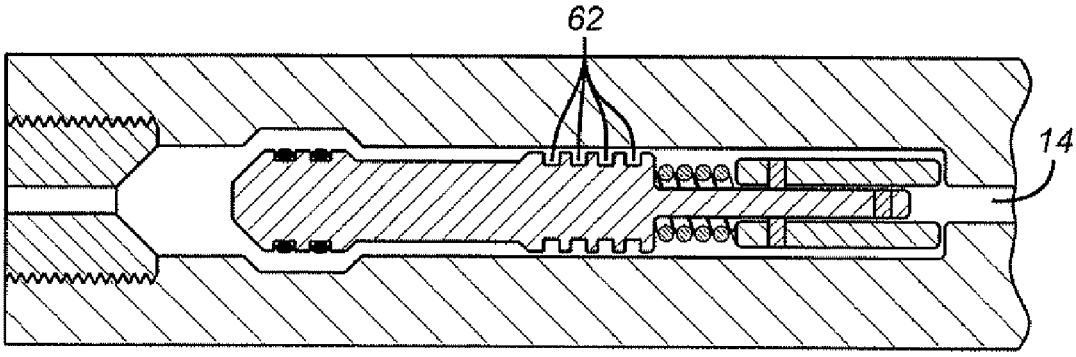
FIG. 5 is the view of FIG. 4 shown with the backup seals gone.

At a certain depth the hydrostatic pressure in the well overcomes the spring 56 and the shear pin 52 to shift body 34 to the right, as shown in FIG. 4. Seals 36 shift away from bore 38 to align with larger bore 46. This creates a gap 60 to allow well fluids in passage 14 to reach the secondary seal assembly 40. The material for seals 40 is selected to react or in other ways interact with well fluids so that after a time, there will no longer be a seal as eventually all the seals 40 present will fail to work and will let well fluids bypass them and continue down passage 14 to chamber 16. This is shown in FIG. 5 where only grooves 62 are illustrated and the seals 40 are gone. In this condition, hydrostatic pressure gets by grooves 62 and goes down passage 14 to chamber 16 to stroke piston 22. Piston 22 can be used to set a packer by compression, for example. Piston 22 can also apply a boost force to a swelling element on a packer, shown schematically as 64 in FIG. 1. This packer 64 can incorporate a cover that prevents initial well fluid contact with the swelling material until the desired depth is reached. Thereafter the covering is removed by interaction with the well fluid and well fluid contact with the underlying element makes it swell while piston 22 applies a boost sealing force to the packer 64.

Figure 3:
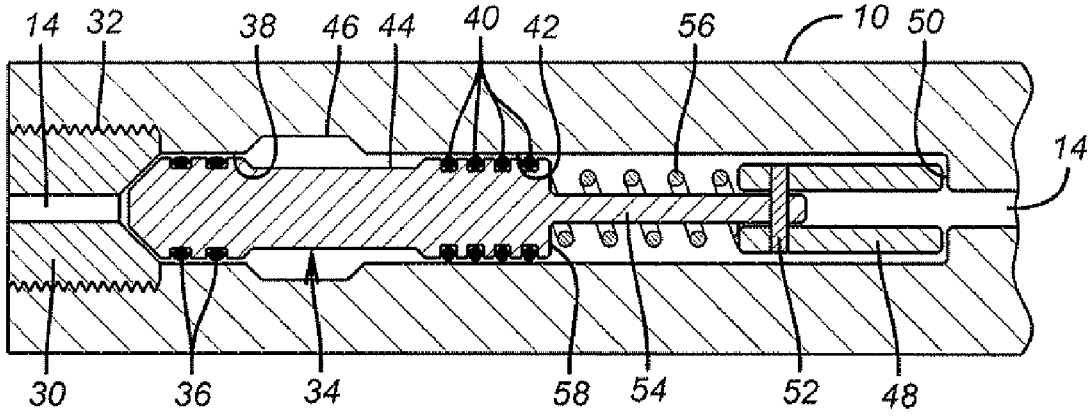
FIG. 3 is a section view of the valve design to replace the valve shown in the prior art design of FIGS. 1 and 2 and shown in the run in position.

Those skilled in the art will appreciate that spring 56 stays compressed after shear pin 52 is broken from hydrostatic pressure. During the time delay that is provided from the removal or disintegration of seals 40 from exposure to well fluids, an opportunity exists to raise the mandrel 10 in which case the hydrostatic force could be reduced to a point where spring 56 could be strong enough to shift the body 34 back to the FIG. 3 position without setting a packer or actuating the tool connected to piston 22.

Alternatively, body 34 can just have seals 36 on it while seals 40 can be on an independent body or alternatively they can comprise a plug in the bore that leads to passage 14.

It is within the scope of the invention to sequentially set a variety of downhole devices using multiple assemblies with a different time constraint on how long it takes for seals 40 to stop functioning once exposed to well fluids. Independently or in conjunction with the disintegration time of seals 40 the strength of spring 56 and shear pin 52 can also be manipulated to obtain the required sequence of operating downhole tools or a series of packers or combinations of different tools such as packers and sliding sleeve valves, for example.

Those skilled in the art will appreciate that an inner string is not necessary using the present invention. This allows substantial savings in time and expense. Similarly, straddle tools are not needed as are commonly used to set external casing packers. Instead, a casing string, for example can simply be lowered into position and the casing packers can set in a preferred sequence, generally from bottom to top. Each packer, of course would have an assembly as depicted in the figures using the valve design discussed in detail with regard to FIG. 3.

The device illustrated initiates the setting sequence on reaching a range of depth yet provides the ability to more precisely position the downhole tool before the trigger mechanism actuates it. Alternatively it offers the possibility of raising the device to prevent actuation during the delay period that starts automatically on getting to a certain depth. The device can be triggered by hydrostatic pressure or applied well pressure or combinations of both. With different delay times sequential tool actuation in a desired order can be achieved. The trigger actions required for the prior designs such as an inner string, dropping a ball on a seat, or pressuring the tubing or annulus is no longer required as the device can begin the setting sequence simply by going to a sufficient depth in the wellbore.

The above description is illustrative of the preferred embodiment and many modifications may be made by those skilled in the art without departing from the invention whose scope is to be determined from the literal and equivalent scope of the claims below.

We claim:

1. A method for setting at least one downhole tool at a desired downhole location, comprising:
- delivering the at least one tool downhole with an associated setting mechanism;
- beginning movement of said setting mechanism during said delivering, that ultimately results in setting the tool;
- using said beginning movement to allow fluid to approach said setting mechanism;
- using said approaching fluid to define the start of a delay period before said tool is set;
- using said approaching fluid to disable a component in said setting mechanism;
- providing said component to be disabled in the form of at least one disappearing seal on a first piston.

2. The method of claim 1, comprising:
- isolating said disappearing seal from well fluids until movement of said first piston.

3. The method of claim 2, comprising:
- using a primary seal on said first piston that blocks access of well fluids to said disappearing seal until said primary seal is bypassed due to automatic first piston movement.

4. The method of claim 1, comprising:
- releasably securing said first piston against initial movement from a blocking access position to the disappearing seal position until a predetermined pressure is acting on it;
- biasing said first piston toward said blocking access position.

5. The method of claim 1, comprising:
- dissolving said disappearing seal to disable it.

6. The method of claim 1, comprising:
- allowing said approaching fluid to bypass said disappearing seal to actuate a second piston against an atmospheric chamber to set the tool.

7. The method of claim 1, comprising:
- delivering a plurality of tools with a plurality of associated setting mechanisms;
- using time delays of different durations on said mechanisms;
- setting the tools in an order determined by the lengths of said delays.

8. A method for setting at least one downhole tool at a desired downhole location, comprising:
- delivering the at least one tool downhole with an associated setting mechanism;
- beginning movement of said setting mechanism during said delivering, that ultimately results in setting the tool;
- providing a time delay between said beginning movement and the setting of said tool;
- dissolving at least one pressure seal to create said delay.

* * * * *